US010852102B2

(12) United States Patent
Sanchez Velez

(10) Patent No.: US 10,852,102 B2
(45) Date of Patent: Dec. 1, 2020

(54) CONFIGURABLE SHOOTING TRAINING SYSTEM AND METHOD OF USING THE SAME

(71) Applicant: Miguel A. Sanchez Velez, Isabela, PR (US)

(72) Inventor: Miguel A. Sanchez Velez, Isabela, PR (US)

( * ) Notice: Subject to any disclaimer, the term of this patent is extended or adjusted under 35 U.S.C. 154(b) by 224 days.

(21) Appl. No.: 15/602,128

(22) Filed: May 23, 2017

(65) Prior Publication Data

US 2017/0336172 A1 Nov. 23, 2017

Related U.S. Application Data

(60) Provisional application No. 62/340,312, filed on May 23, 2016.

(51) Int. Cl.
*F41G 3/26* (2006.01)
*F41J 5/00* (2006.01)

(52) U.S. Cl.
CPC ..... *F41G 3/2616* (2013.01); *F41J 5/00* (2013.01)

(58) Field of Classification Search
CPC ..... F41A 33/00; F41A 33/02; F41A 33/04; F41A 33/06; F41G 3/26; F41G 3/2616; F41G 3/2662; F41J 5/00
See application file for complete search history.

(56) References Cited

U.S. PATENT DOCUMENTS

2005/0128437 A1* 6/2005 Pingali ..... H04N 9/3194 353/69
2008/0194337 A1* 8/2008 Hensel ..... A63B 24/0021 463/48
2009/0111073 A1* 4/2009 Stanley ..... F41A 33/00 434/21
2014/0285631 A1* 9/2014 Janky ..... G01C 21/206 348/47
2016/0231087 A1* 8/2016 Dvorkin ..... F41G 3/2605

* cited by examiner

*Primary Examiner* — Timothy A Musselman
(74) *Attorney, Agent, or Firm* — Hoglund & Pamias, PSC; Roberto J. Rios

(57) ABSTRACT

The invention provides a system for pointing targets, at a random sequence, by parameters determined by the device itself or by a human operator. The system includes a main unit and optional remote input/output devices. The system includes a plurality of pointing laser devices that are moveable and rotatable allowing to aim the pointing devices individually. A remote device could be attached or integrated into a firearm.

19 Claims, 13 Drawing Sheets

CONFIGURABLE SHOOTING TRAINING SYSTEM AND METHOD OF USING THE SAME

BACKGROUND OF THE INVENTION

There are many known device for target shooting training, sporting and competition. They are generally used in target shooting activities or sports like pistol, rifle, shotgun and crossbow shooting and archery, among others. Accuracy and speed are very important skill to develop in this type of activities, especially under stressful circumstances. One way to develop these skills is by target shooting but at random sequence for the user. There are several available methods for random target selection: mechanical moving targets, living moving targets and unique symbol targets.

Mechanical moving target—the targets moves, probably, from a hidden location or the target is propelled from a device or a second person.

Living moving targets—the target is a living creature, like a pigeon or duck that moves freely.

Unique symbol targets—each target has a unique symbol, generally a number, letter, color or shape. A second person indicates verbally to the shooter the unique symbol corresponding to the target to shoot.

What is needed is a configurable method and a system for random target pointing, that does not require moving targets, verbal signals, a second person or the sacrifice of living creatures.

SUMMARY OF THE INVENTION

The present invention is a new and practical option for rapid target acquisition training. The system is small and portable allowing the user to carry and use it, almost anywhere. The system could be used by a user alone or with the aid a second person depending on the operation mode. The system of the present invention is a low power consumption system that could even be operated on built-in or removable batteries.

One aspect of the invention, is that it helps a user surpass stress and to improve speed and precision during training developing skills related to rapid target acquisition.

According to another aspect of the invention, a user skills can be compared against other users also using the system, regardless of their locations. The system also measures individual performance and progress through the collection and comparison of statistical data.

BRIEF DESCRIPTION OF THE DRAWINGS

Further features and advantages of the invention will become apparent from the following detailed description taken in conjunction with the accompanying figure showing illustrative embodiments of the invention, in which.

Throughout the figures, the same reference numbers and characters, unless otherwise stated, are used to denote like elements, components, portions or features of the illustrated embodiments. The subject invention will be described in detail in conjunction with the accompanying figures, in view of the illustrative embodiments.

DETAILED DESCRIPTION OF THE INVENTION

Figure 1:
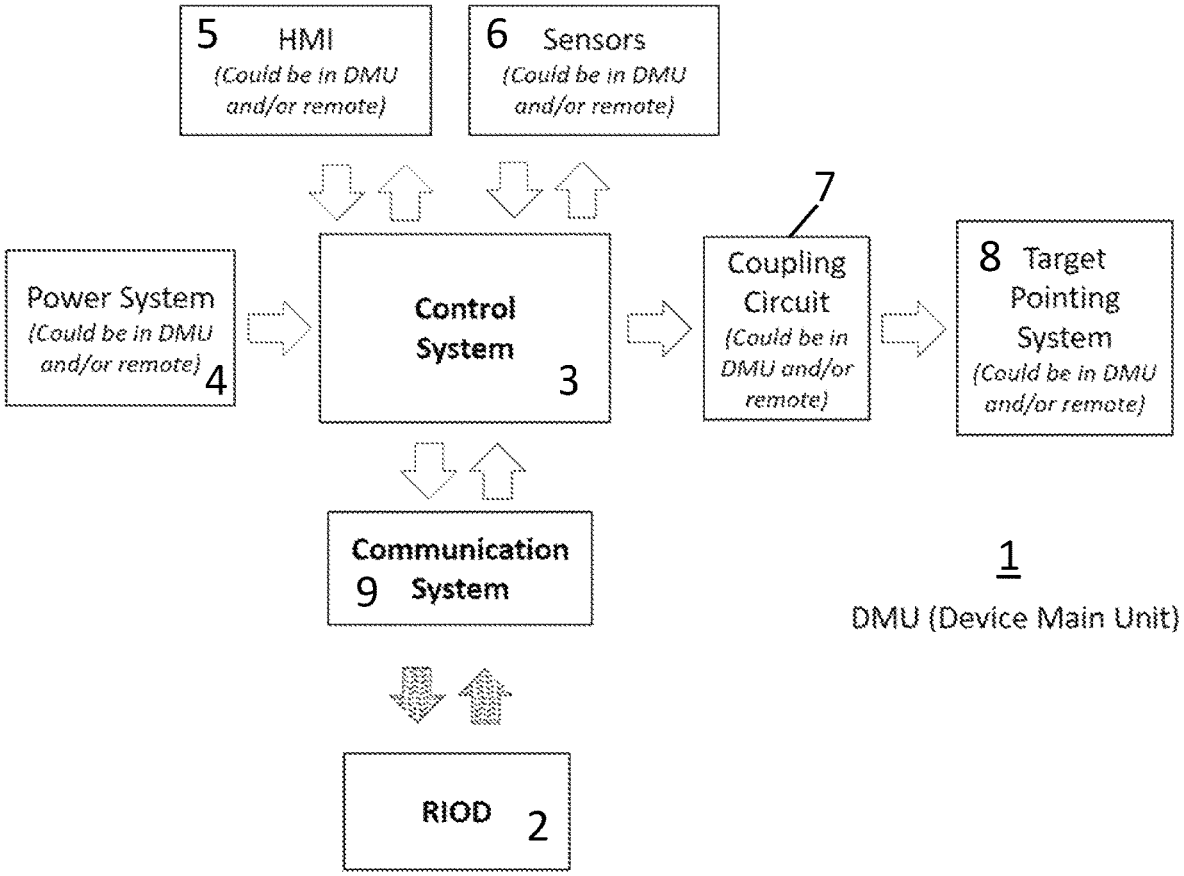
FIG. 1 is a block diagram of the Device Main Unit according to the present invention.
Figure 2:
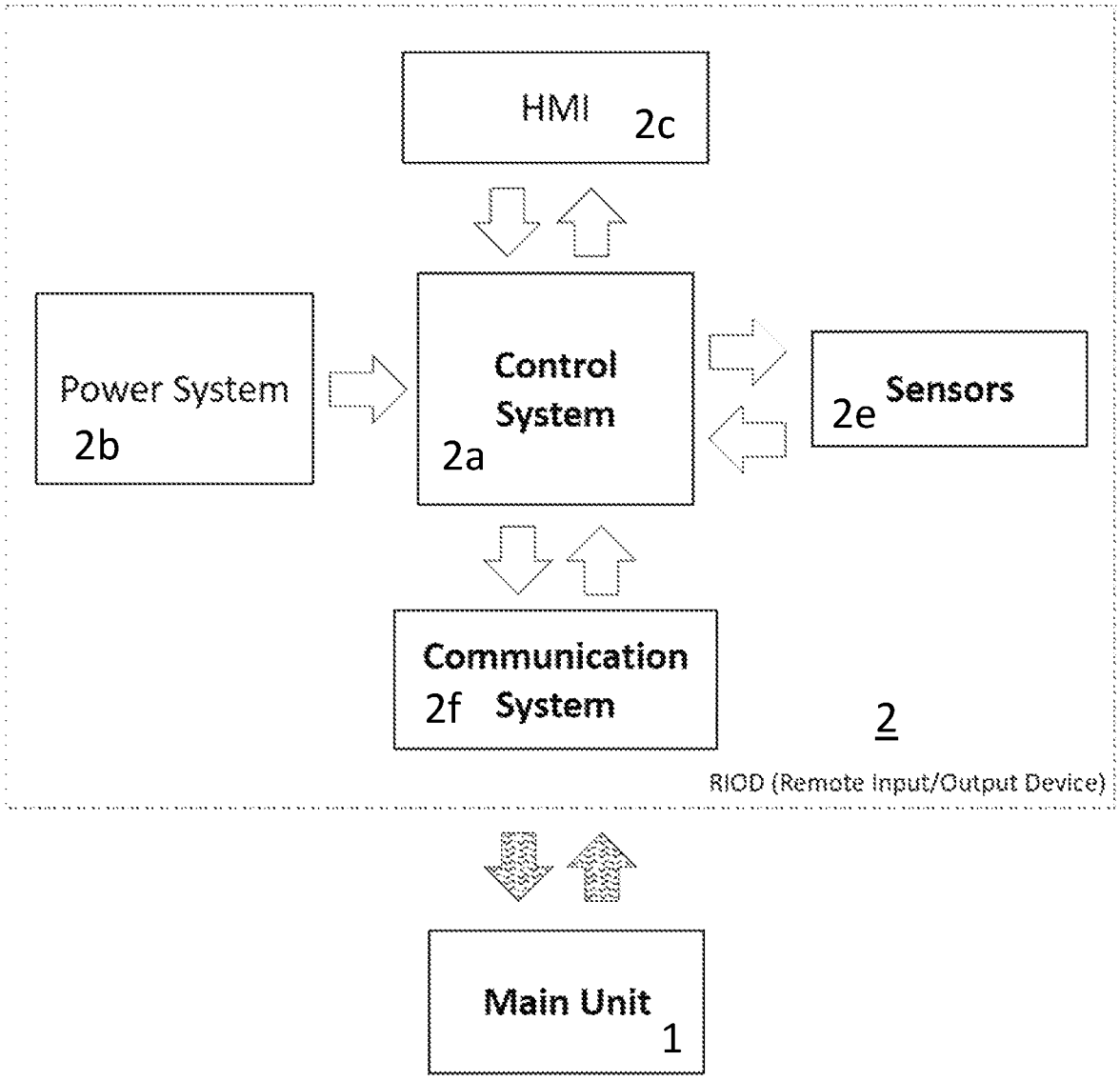
FIG. 2 is a block diagram of the Remote Input/Output Device according to the present invention.

FIGS. 1 and 2 illustrate block diagrams of the shooting training system according to a preferred embodiment of the invention. The invention is embodied as an apparatus having a device main unit (DMU) 1 that contains all the necessary controls, interfaces and equipment needed for the operation of the system and an optional remote input/output device (ROID) 2 that communicates with the main device unit 1 to give a user an optional and/or additional control method of the system. In general terms, the main device unit 1 includes a control system 3 connected to a Human-Machine Interface (HMI) 5, at least one sensor 6, a coupling circuit 7 that couples a target pointing system 8 with the control system 3, a communication system 9 that provides bi-directional communication between the main unit 1 and the remote device 2, and a power system 4. As can be appreciated, certain components of the system have bi-directional communication between them, such as: the HMI 5, the communication system 9 and the control system 3. The RIOD 2 according to a preferred embodiment of the invention, includes a HMI 2*c*, sensors 2*e*, a communication system 2*f*, a power supply 2*b* and a control system 2*a* that controls the internal operation of the ROID 2 as well as the external communication to the DMU 1.

Figure 3:
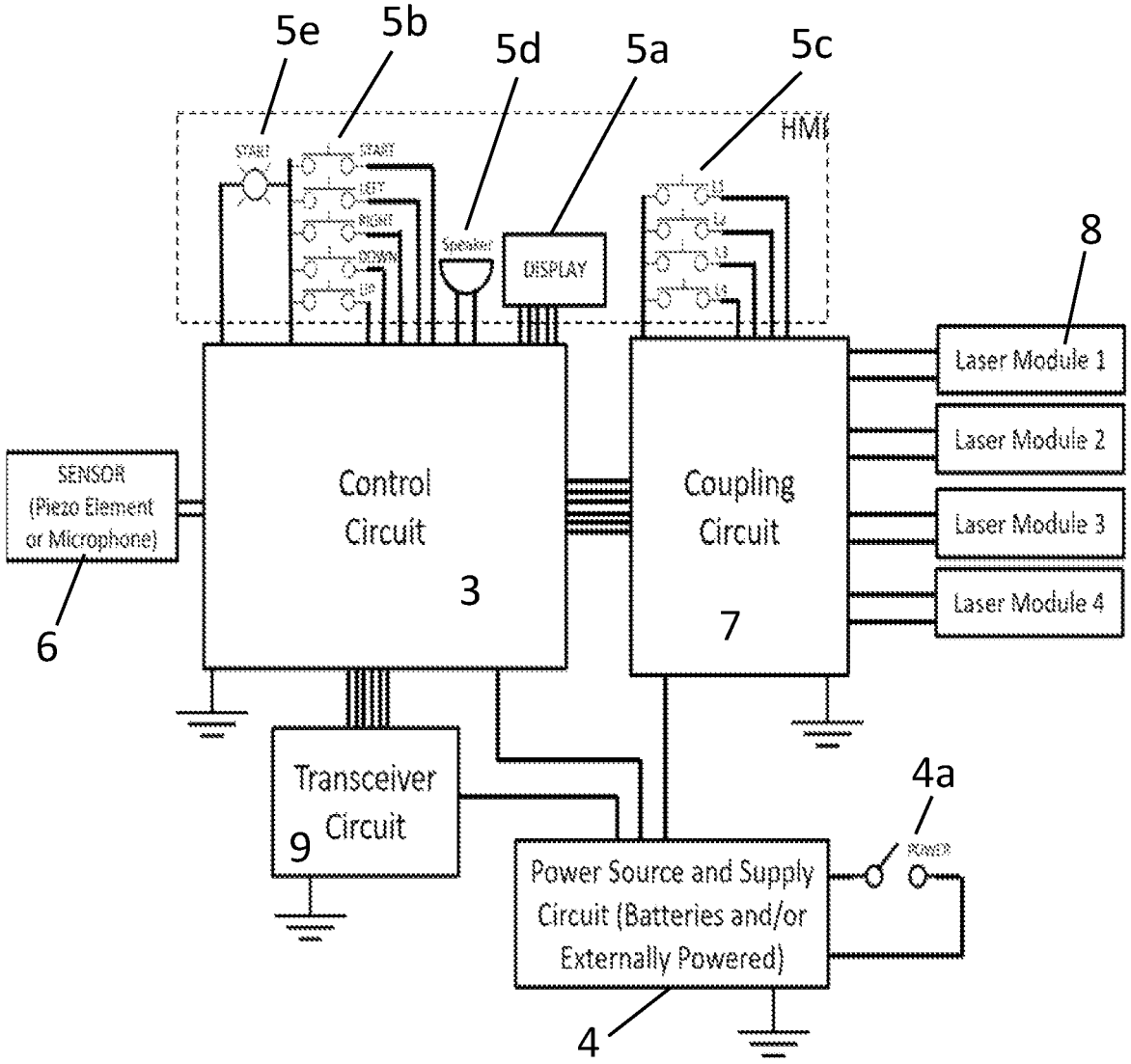
FIG. 3 is an electrical schematic of the Device Main Unit according to the present invention.

A more detailed electrical schematic of the Device Maun Unit (DMU) 1 is illustrated in FIG. 3. In a preferred embodiment, the HMI 5 comprises a display 5*a* connected to the control system 3 to provide the user with visual information related with the system control as well as visual feedback of the system operation such as but not limited to shooting and timing statistics. A plurality of input switches 5*b* are provided including directional switches to facilitate navigation within a graphical user interface (GUI) of a software ran by the control system 2*a* and displayed through the display 5*a* as well as an ON/OFF switch to selectively power the DMU 1. A "GO" button is also provided so that the user starts the system by depressing the button which actuates a start switch 5*b* that instructs the control system 3 to begin operation and visual indicia 5*e* turns on to provide visual confirmation to the user. Individual laser switches 5*c* are provided to individually turn on the pointing lasers bypassing the system in order to calibrate and direct each laser according to a desired direction and intensities. A speaker 5*d* provides audio indication to the user of the system controls and/or the system instructions so that a user is able to use the system without having to take his/her sight away from the targets while shooting. A coupling circuit 7 is connected between the control circuit 3 and the plurality of laser modules 8 and is also connected to the plurality of Individual laser switches 5*c* for individual control of the plurality of laser modules 8 which will be explained in detail later. Sensors 6 such as but not limited to: microphones and/or piezo-electric sensors are connected as inputs to the control circuit 3. A transceiver circuit 9 is also connected to the control circuit 3 to establish bi-directional communications to/from the control circuit 3 and a power source or supply 4 is connected to power all the necessary components of the system via a power switch.

Figure 4:
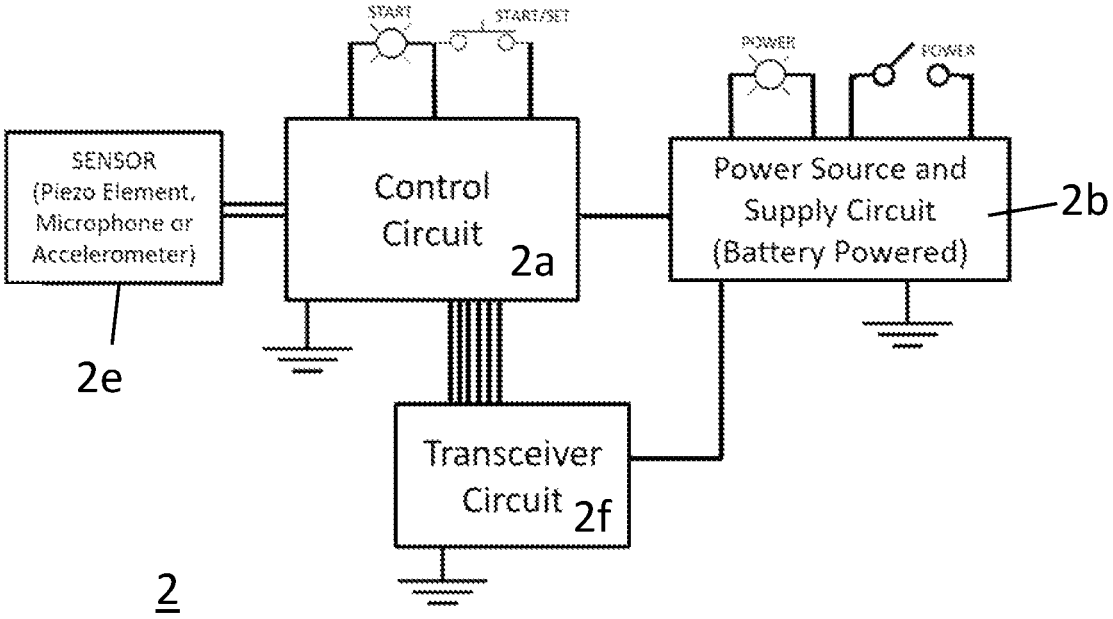
FIG. 4 is an electrical schematic of the Remote Input/Output Device according to the present invention.

The RIOD 2 is provided with a control circuit 2*g* having a start/set switch that selectively activates and controls operation of the RIOD 2 as illustrated in FIG. 4. A sensor 2*e* such as but not limited to: microphone, piezo-electric sensor and an accelerometer is also connected to the control circuit 2*g*. A transceiver 2*f* is connected to the control circuit to establish bi-directional communications to/from the RIOD 2 and a power source or supply 2*b* is connected to power all the necessary components of the system via a power switch. In a preferred embodiment, the power source 2*b* is a battery or any other alternative source that allows wireless use of the RIOS 2. Indicating lights are provided to indicate when the system is started and powered.

Figure 5:
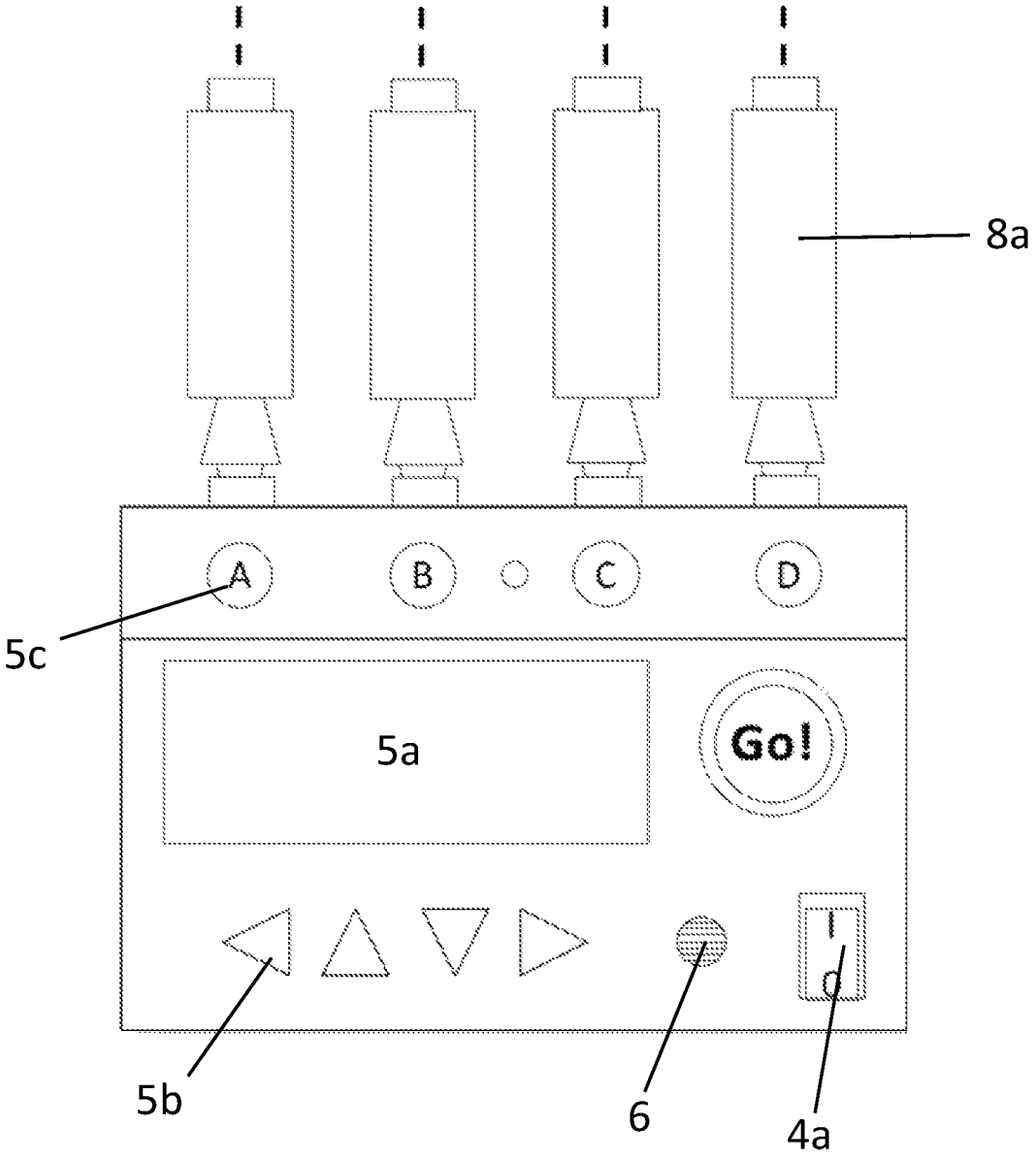
FIG. 5 is a top view of the Device Main Unit housing according to the present invention.
Figure 6:
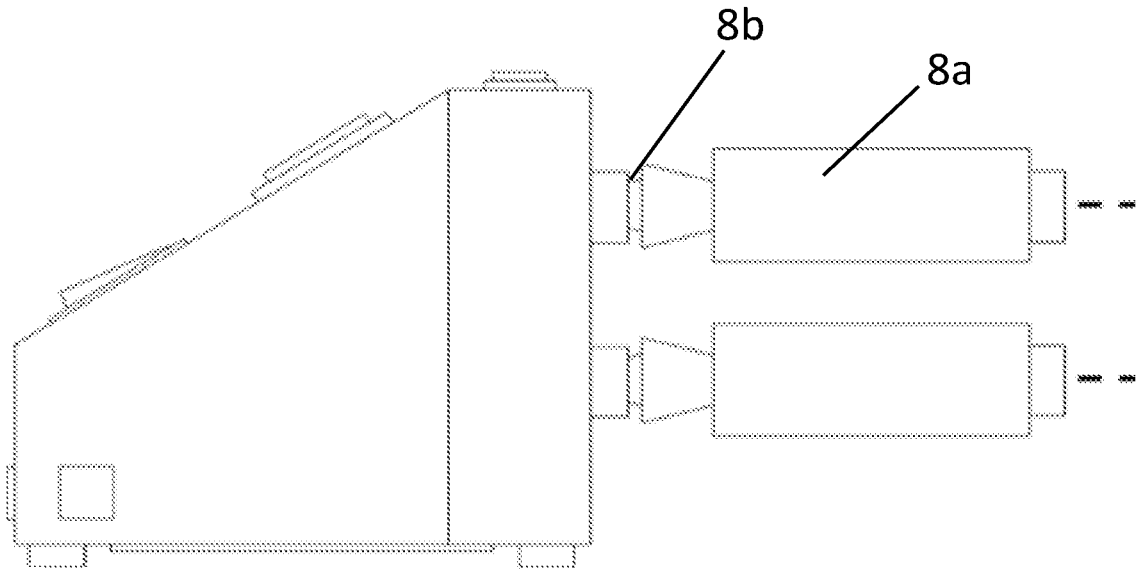
FIG. 6 is a side view of the Device Main Unit housing according to the present invention.
Figure 7:
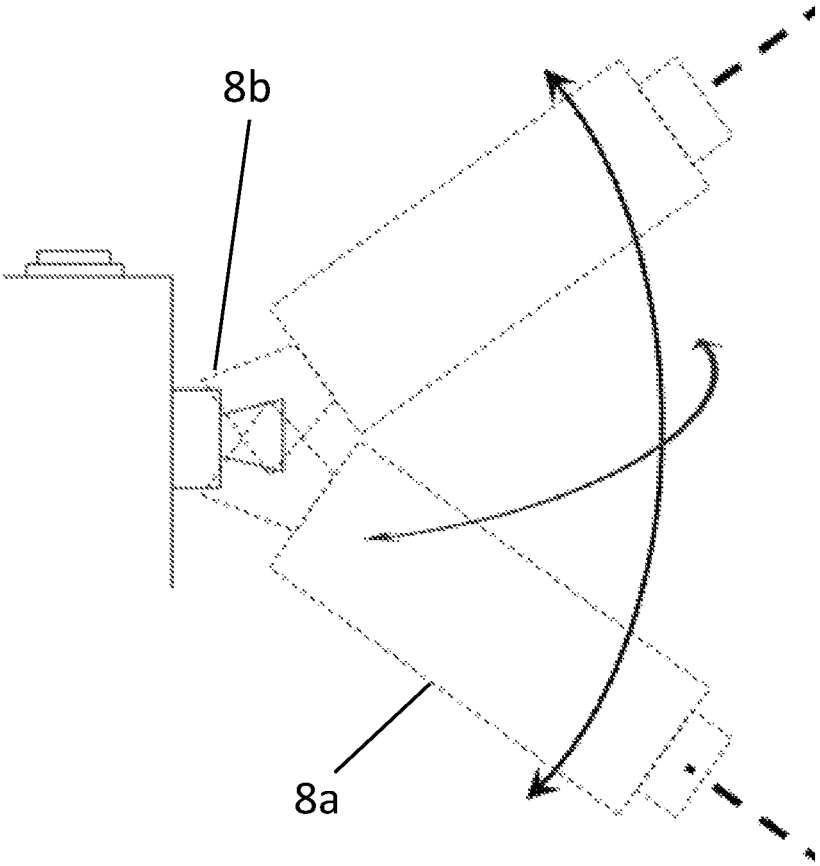
FIG. 7 illustrates the pivoting/rotation mechanism of the laser modules according to the present invention.

According to a preferred embodiment, the components of the DMU 1 are enclosed on a housing 10 made of a solid material such as but not limited to: plastic, metal or a combination thereof, as illustrated in FIGS. 5-7. The housing 10 contains the display 5*a* and a plurality of directional buttons for actuating input switches 5*b* that allow a user to navigate through the graphical user interface (GUI) that is shown in display 5*a*. A speaker 6 is also provided to provide audible alerts and instructions to the user while operating the system. As can be appreciated, the plurality of laser modules 8 are attached to the housing 10 by means of a pivoting/rotating mechanism 8*b* that allows each laser module 8 to be freely moved in any direction in order to aim the laser at a desired location. Buttons (A)-(B)-(C)-(D) are provided for actuating individual laser switches 5*c* so that a user can bypass the system and manually activate each laser module 8 to test and calibrate the system as well as to ensure that the laser module 8 is aimed at the right direction. In a preferred embodiment, a start button is provided with visual indicia, such as the word "GO!", so that when a user depresses the button the start switch is actuated beginning the training session and the button is illuminated. A power ON/OFF button is also provided.

Figure 8:
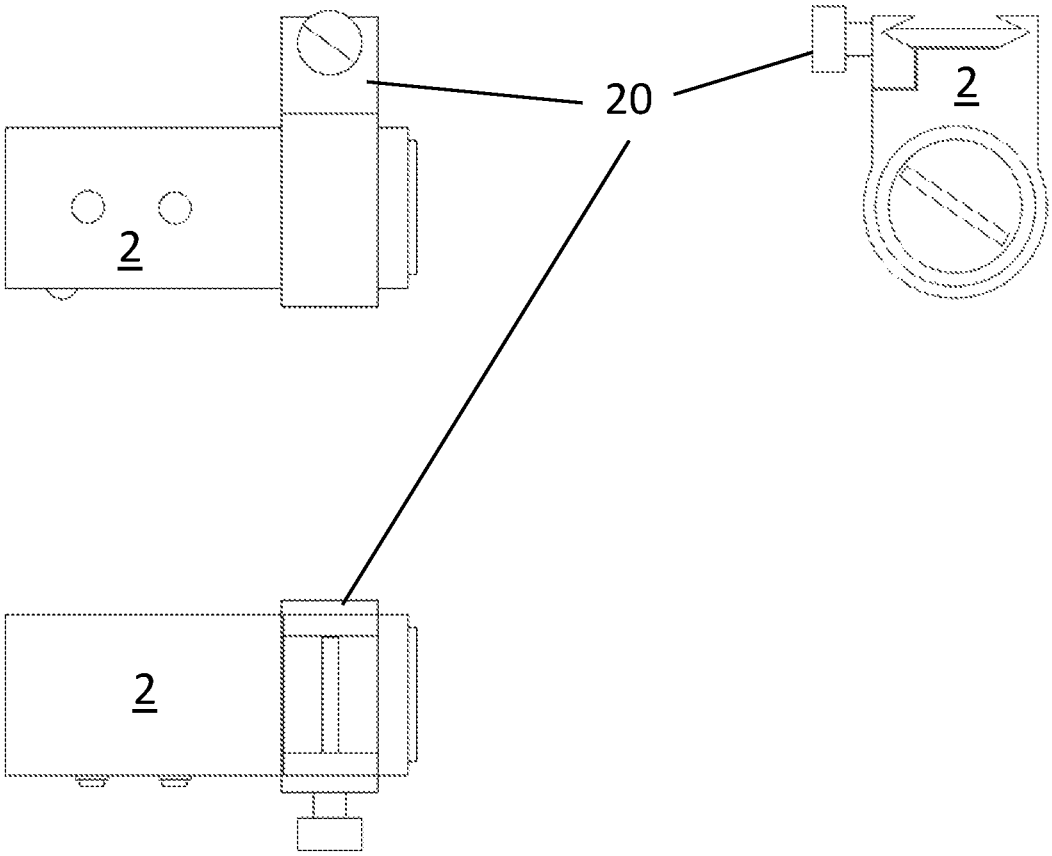
FIG. 8 illustrates the Remote Input/Output Device according to the present invention.
Figure 9:
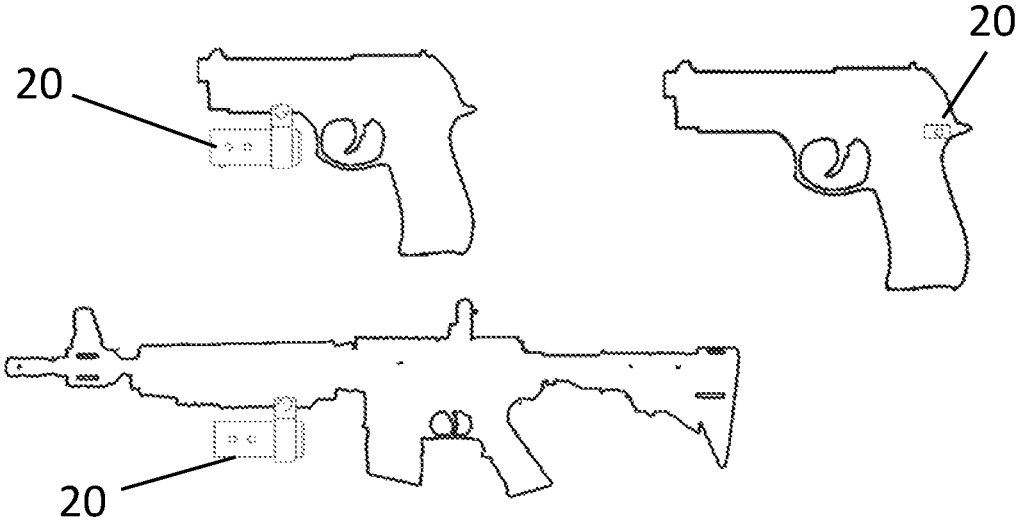
FIG. 9 illustrates the Remote Input/Output Device attached or integrated to a firearm according to the present invention.

FIGS. 8 and 9 illustrate the optional RIOD 2 according to the present invention. As can be appreciated, an attaching member 20 is provided for attaching the RIOD 2 housing to a portion of a fire arm or alternatively, the RIOD 2 can be integrated into the firearm body itself. As previously explained, the RIOD 2 contains a sensor 2*e* that in a preferred embodiment detects when a firearm is shot and communicates a triggering signal to the DMU 1 for activating the laser modules 8 according to the operation mode. The housing is provided with actuating buttons that allow a user to remotely set and start the training session.

Figure 10:
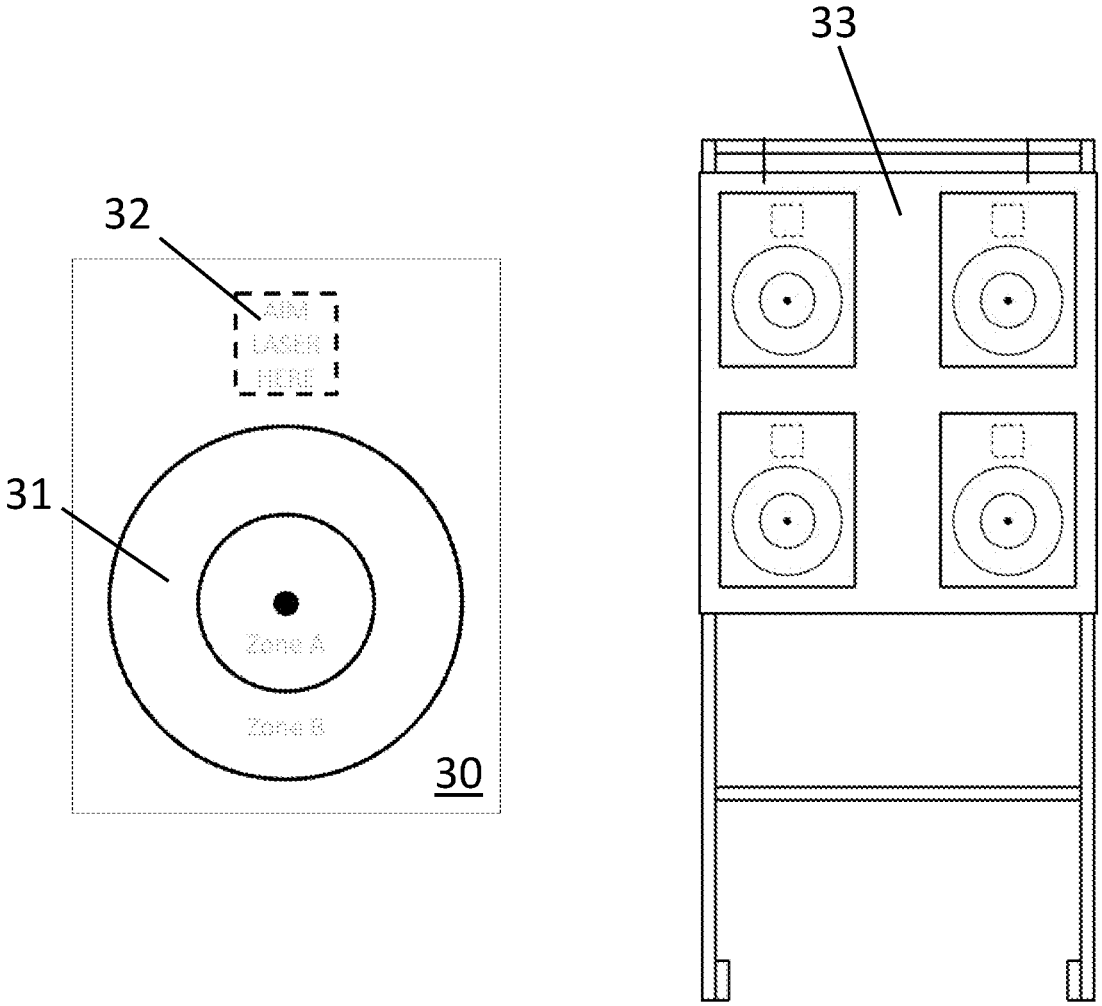
FIG. 10 shows a target board and panel arrangement according to the present invention.

FIGS. 10A and 10B illustrate a target panel configuration according to the present invention. A target board 30 is provided having a traditional target/bulls eye portion 31 and a portion with indicia 32 having the message: "AIM LASER HERE". As can be appreciated, a plurality of panel boards 30 can also be arranged on a target panel 33 for facilitating the training session to the user.

Figure 11:
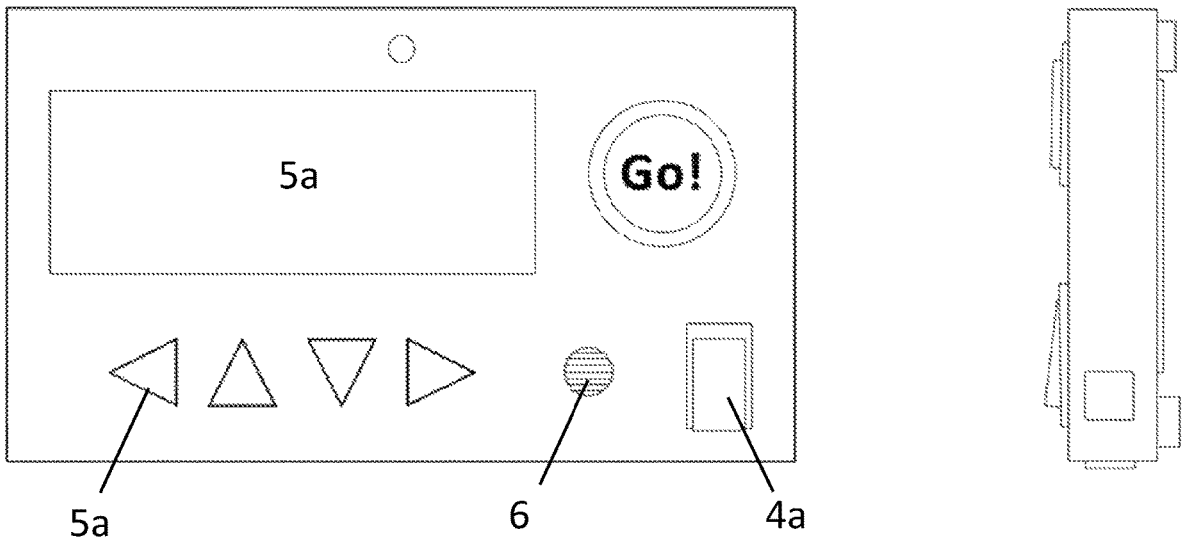
FIG. 11 illustrates the Device Main Unit without the laser modules according to the present invention.
Figure 12:
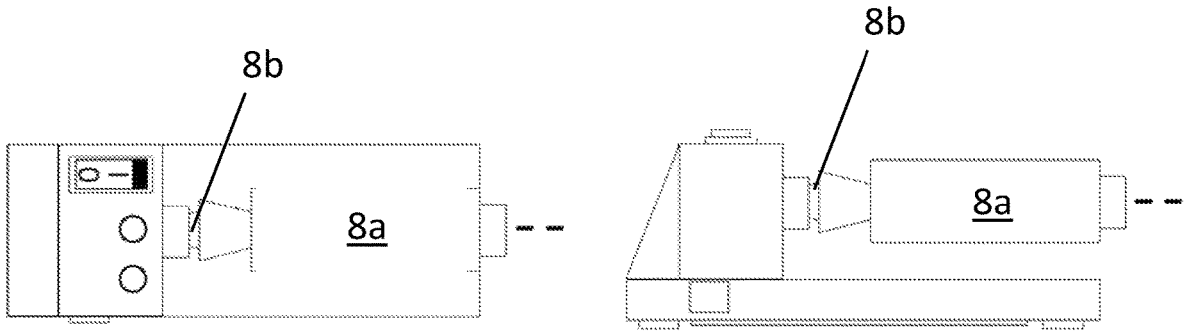
FIG. 12 illustrates the laser modules as a stand-alone unit according to the present invention.
Figure 13:
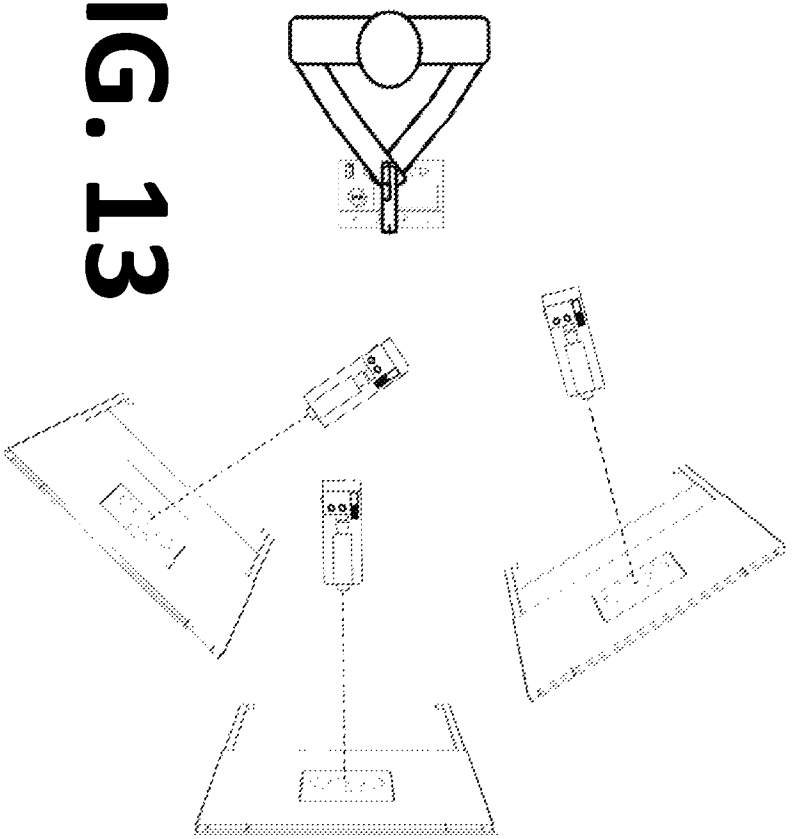
FIG. 13 shows the system used by a person with the stand-alone laser units according to the present invention.
Figure 14:
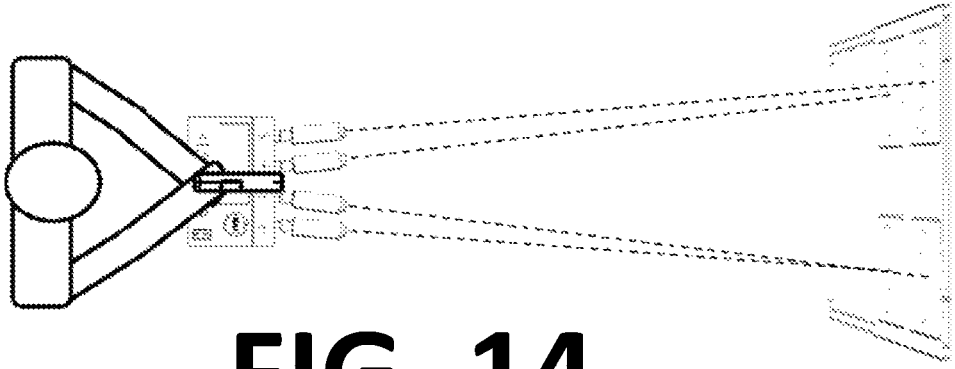
FIG. 14 shows the system used by a person with the Device Main Unit including the laser units according to the present invention.

While the embodiments shown in FIGS. 1-7 illustrate a single housing enclosing all the components it is also envisioned that the laser modules 8 can be provided on separate units remotely controlled by the DMU 1 as shown in FIGS. 11-13. Each remote unit will have its own power supply with coupling circuit and set/start switches while the DMU 1 will retain the necessary components to control the system and perform communications between the remote units and the DMU 1. Specifically, FIG. 13 illustrates the system in use where a plurality of remote units is positioned across a shooting room and were individually moved and aimed at respective target boards 30. In this embodiment communication between the remote units and the DMU 1 can be implemented wired or wireless via any well-known communications means. FIG. 14 shows the system being used be a person where the laser modules 8 are integrated with the DMU 1.

In operation, a user moves and aims each laser modules 8 to specific target boards 30 while depressing buttons (A)-(B)-(C)-(D) to actuate individual laser switches 5*c* bypassing the system and manually activating each laser module 8 to ensure that it is aimed at the right direction and portion of the target board 30. The user proceeds to program the system by selecting operating parameters such as but not limited to: an operation mode, triggering signals, number of shots, etc . . . Once the system is configured the user depressed the "GO!" button and the lasers will be actuated according to the operation mode and the configured parameters until reaching the selected number of shots for the session. Afterwards, the system provides the user with statistical data related to performance of the shooting session based on recorded data obtained during the session.

For a better understanding of the capabilities of the invention an example will be explained. A user access the GUI of the system and selects the following session parameters and the system recorded the corresponding results:

| Training Parameters | |
|---|---|
| Distance from targets | 7 yards |
| Targets Zone to maintain shots | A |
| Number of Shots | 10 |
| **Results** | |
| Total Time | 9.75 seconds |
| Best reaction time | 0.85 seconds |
| Worst reaction time | 1.60 seconds |
| Average reaction time | 0.98 seconds |

The user selects the detection of the shots sound as a triggering signal for switching the laser modules 8 and begin the session. In this Example, a time of 9.75 seconds passed from the time the first laser module 8 was activated to the time the last shot was made and the system calculated statistic reaction times (the time elapsed between a laser activation and a corresponding shot) as shown in the table above.

While referred embodiments have been explained it is understood that alternate modification are encompassed by the invention. For example, only four laser modules are illustrated in the Figures, but the system can be used with any amount of laser modules arranged either on a single or separate housings. Also, the main aiming means are lasers, however other type of light means could be used. The several apparatus and units of the system can work connected to a wall power outlet and/or could be configured to be portable and self-powered. Communication between the modules and the units can be wired or wireless such as: Radio Frequency, infrared, Wi-Fi, Bluetooth, among others. In addition, more than one communication method can be used at a time and remote repeaters could be provided to extend the wireless transmission range. The RIOD can be attached or integrated to a firearm or other artifacts depending on the case. While a person is using the system a second person can from a secure position, activate the lasers by depressing a button on the DMU or the RIOD when is not attached to a firearm. Control features are provided so that the user can vary the target switching speed, the switching triggering signal, the number of targets to be pointed at same time, the number of shots and to manually activate the lasers. Monitoring and recording features are also provided for showing a user on the display the target switching time, the operating mode and user statistical data. The system can also include the integration of remote controlling or monitoring via a computer or a smartphone. In the case of a Smartphone, a mobile app is provided that enables communication with the system to selectively enters all the parameters and control the operation of the system as well as to receive statistical data from the system for presentation to the user on the mobile app. Power to the system and its component could be provided externally (e.g. Wall Electric Outlet) and/or internally (e.g. Integrated Battery) and a battery charging circuit could also be provided. The user interface comprises of hardware and/or software that allow user inputs to be translated as signals for machines that, in turn, provide the required result to the user. The inputs and outputs could include without limitation: motion sensors, keyboards, remote controls and similar peripheral devices, speech-recognition, smartphones, interfaces and any other interaction in which information is exchanged using visual, audible, heat and other cognitive and physical modes. The interface also includes machine outputs such as: speakers, LEDs and a display that allow user to operate and monitor the system. When the laser modules are provided as separate units, the modules could have its own user interface, power supply, control circuit, communication circuit, sensors and coupling systems. The system of the present invention could be used in any type of sport, training or task that uses targets, or in which could be helpful to point objectives in a random way to the user.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

I claim:

1. A shooting training system comprising:

a static housing enclosing a control circuit;

a user interface provided on an exterior surface of said static housing and being connected to said control circuit in order to control activation of a light module;

at least one sensor connected to said control circuit;

a transceiver circuit connected to said control circuit; and at least one movable aiming element that includes said light module and a pivoting/rotating mechanism structurally attaching said light module to the exterior surface of said static housing so that said light module is selectively moved to direct light from said light module to a remote target.

2. The system of claim 1, further comprising a remote unit having: a remote control circuit; a start switch connected to said remote control circuit; a remote transceiver circuit connected to said remote control circuit; and a power supply circuit.

3. The system of claim 2, further comprising at least one remote sensor connected to said remote control unit.

4. The system of claim 3, wherein said at least one remote sensor comprises: a piezo-electric sensor, a sound sensor, an accelerometer, a vibration sensor or any combination thereof.

5. The system of claim 2, wherein said remote unit is either: attached to a weapon or integrated into said weapon.

6. The system of claim 2, wherein said transceiver circuit communicates with the remote transceiver circuit of said remote unit.

7. The system of claim 2, wherein the light from said light module is activated based on a signal received from said remote unit.

8. The system of claim 1, wherein said user interface includes input and output elements that allow a user to control the system so that the light from said light module is selectively activated.

9. The system of claim 8 further comprising bypass switches provided to selectively activate the light from said light modules individually and independently from said user interface.

10. The system of claim 1, wherein said control circuit activates the light from said at least one movable aiming elements based on: a triggering condition sensed by said at least one sensor, software stored on said control circuit, a timer, and user selection.

11. The system of claim 1, wherein the light from said light module is activated at a predetermined order or at a random order.

12. The system of claim 1, wherein the light module is attached to a single static housing.

13. The system of claim 1, wherein the light module is attached to different static housings.

14. The system of claim 1, wherein said control circuit controls at least one of: activation speed of the light from said light module activation order of the light from the light module and an amount of the lights from the light module of said at least one movable aiming element that are simultaneously activated.

15. The system of claim 1, wherein said light from the light module comprises a laser.

16. The system of claim 1, wherein said transceiver circuit communicates with an external device so that: said external device controls the activation of the light from said light module, and the control circuit provides said external device with information related to the operation of the system.

17. The system of claim 16, wherein said external device comprises at least one of: a portable phone and a computer, having software that allows remote activation of the light from said light module and provides a user with information related to the operation of the system.

18. The system of claim 1, wherein the control circuit measures at least one of: a time span between shots, a time span between activation of a light from said light module and a shot, and a total time for firing a predetermined amount of shots.

19. The system of claim 1, wherein said light module is moved freely in any direction.

* * * * *